US012467388B2

(12) United States Patent
Andrisani et al.

(10) Patent No.: US 12,467,388 B2
(45) Date of Patent: Nov. 11, 2025

(54) SYSTEM FOR SYNCHRONIZING SWITCHING BETWEEN TWO ROCKERS

(71) Applicant: Eaton Intelligent Power Limited, Dublin (IE)

(72) Inventors: Nicola Andrisani, Cumiana (IT); Emanuele Raimondi, Collegno (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 18/828,968

(22) Filed: Sep. 9, 2024

(65) Prior Publication Data

US 2025/0003356 A1 Jan. 2, 2025

Related U.S. Application Data

(63) Continuation of application No. PCT/EP2023/025156, filed on Apr. 4, 2023.

(60) Provisional application No. 63/366,965, filed on Jun. 24, 2022, provisional application No. 63/326,946, filed on Apr. 4, 2022.

(51) Int. Cl.
*F01L 1/18* (2006.01)
*F01L 13/06* (2006.01)

(52) U.S. Cl.
CPC ..... *F01L 1/18* (2013.01); *F01L 13/06* (2013.01)

(58) Field of Classification Search
CPC . F01L 1/18; F01L 13/06; F01L 13/065; F01L 2001/186; F01L 1/185
See application file for complete search history.

(56) References Cited

U.S. PATENT DOCUMENTS

| | | | |
|---|---|---|---|
| 4,899,701 A | 2/1990 | Inoue | |
| 4,942,853 A | 7/1990 | Konno | |
| 5,207,193 A | 5/1993 | Sugimoto | |
| 5,388,552 A | 2/1995 | Sugimoto | |
| 2011/0226206 A1 | 9/2011 | Riley | |

FOREIGN PATENT DOCUMENTS

| | | | | |
|---|---|---|---|---|
| EP | 265191 A * | 4/1988 | ..... | F01L 1/267 |
| WO | WO-2010103637 A1 * | 9/2010 | ..... | F01L 1/047 |

OTHER PUBLICATIONS

International search report and Written Opinion received for PCT Application No. PCT/EP2023/025156, 8 pages.

* cited by examiner

*Primary Examiner* — Hung Q Nguyen
(74) *Attorney, Agent, or Firm* — Baker Botts L.L.P.

(57) ABSTRACT

In one embodiment, a system for synchronization is provided. The system comprises a switchable first rocker arm, a switchable second rocker arm, a first switching mechanism arranged in the first rocker arm and configured to controllably switch the first rocker arm by moving between a first position and a second position, and a second switching mechanism arranged in the second rocker arm and configured to controllably switch the second rocker arm by moving between a third position and a fourth position. Switching of the first rocker arm and switching of the second rocker arm are implemented by a single actuation source and controlled to occur in sequence.

19 Claims, 8 Drawing Sheets

SYSTEM FOR SYNCHRONIZING SWITCHING BETWEEN TWO ROCKERS

PRIORITY

This application claims the benefit under 35 U.S.C. § 365(c) of International Patent Application No. PCT/EP2023/025156, filed 4 Apr. 2023, which claims the benefit of U.S. Provisional Application No. 63/326,946, filed 4 Apr. 2022, and U.S. Provisional Application No. 63/366,965, filed 24 Jun. 2022, each of which is incorporated herein by reference.

TECHNICAL FIELD

This disclosure generally relates to valve actuation system, and more particularly to a system for synchronizing switching between two rocker arms in a valvetrain assembly.

BACKGROUND

Valve actuation systems are well known in the art, which are typically employed for use in internal combustion engines. Some valvetrain designs may be configured with variable valve lift function in which the height a valve opens may vary in an attempt to improve engine performance, fuel economy or exhaust gas emission. Some variable valve lift functionalities require switching of a first rocker and a second rocker to deliver desired function. For example, with switching of the rocker, one can select whether the cam can actuate the associated valve or not. Generally, it may be desirable to control switching of the first rocker and the second rocker to occur at proper timing. Because of the valve lift sequence, for the purpose of ensuring a safe switching event, in a conventional valve actuation system, correct sequence of switching can require an independent control system for the two rockers and a central unit to synchronize the electronic control signal. This increases size and complexity of the overall system.

Accordingly, there is a need to achieve a system for synchronizing switching between two rocker arms that uses simplified mechanisms to control proper switching.

SUMMARY OF PARTICULAR EMBODIMENTS

The disclosure presents a system for synchronization that helps to reduce size and complexity of the valve actuation system and guarantees correct sequence of rocker arm switching by employing a single control source to mechanically implement switching of the two rocker arms.

In one embodiment, a system for synchronization comprises a first rocker arm configured to be switchable between a first mode and a second mode, a second rocker arm configured to be switchable between a third mode and a fourth mode, a first switching mechanism arranged in the first rocker arm and configured to controllably switch the first rocker arm between the first mode and the second mode by moving between a first position and a second position, and a second switching mechanism arranged in the second rocker arm and configured to controllably switch the second rocker arm between the third mode and the fourth mode by moving between a third position and a fourth position. Movement of the first switching mechanism and movement of the second switching mechanism are actuated by a single actuation source. Furthermore, movement of the first switching mechanism between the first position and the second position causes the second switching mechanism to move between the third position and the fourth position such that switching of the first rocker arm and the second rocker arm occurs in sequence.

In particular embodiments, the single actuation source is a fluid control valve.

In particular embodiments, the first rocker arm and the second rocker arm are arranged in close proximity to each other.

In particular embodiments, at least a portion of the first switching mechanism and at least a portion of the second switching mechanism are configured to maintain physical contact with each other.

In particular embodiments, the system for synchronization further comprises a return spring coupled to the second switching mechanism and configured to bias both the first switching mechanism and the second switching mechanism.

In particular embodiments, the first rocker arm comprises a deactivating roller, which is configured to be selectively latched by the first switching mechanism such that the first rocker arm is selectively switched between the first mode and the second mode.

In particular embodiments, the second rocker arm comprises a first fluid circuit and a second fluid circuit. In particular embodiments, the second switching mechanism comprises a spool valve. In particular embodiments, the spool valve is configured to selectively enable or disable fluid communication between the first fluid circuit and the second fluid circuit of the second rocker arm such that the second rocker arm is selectively switched between the third mode and the fourth mode.

In particular embodiments, the first switching mechanism comprises a spool valve. In particular embodiments, the first rocker arm comprises a first fluid circuit and a second fluid circuit. In particular embodiments, the spool valve is configured to selectively enable or disable fluid communication between the first fluid circuit and the second fluid circuit of the first rocker arm. In particular embodiments, the second rocker arm comprises a third fluid circuit that is configured to hydraulicly interface with the second fluid circuit of the first rocker arm. In particular embodiments, movement of the second switching mechanism is actuated by fluid supplied from the first fluid circuit through the second fluid circuit to the third fluid circuit such that the second rocker arm is switched between the third mode and the fourth mode.

In particular embodiments, the system for synchronization further comprises a first return spring coupled to the first switching mechanism and configured to bias the first switching mechanism, and a second return spring coupled to the second switching mechanism and configured to bias the second switching mechanism.

In particular embodiments, the first rocker arm and the second rocker arm are biased to press against each other by one or more biasing spring.

BRIEF DESCRIPTION OF THE DRAWINGS

Embodiments in accordance with this disclosure will now be described by reference to the accompanying drawings, in which.

DESCRIPTION OF EXAMPLE EMBODIMENTS

Reference will now be made in detail to the examples which are illustrated in the accompanying drawings. Wherever possible, the same reference numbers will be used throughout the drawings to refer to the same or like parts. Directional references such as "up", "down", "right", and "left" are for case of reference to the figures.

Figure 1:
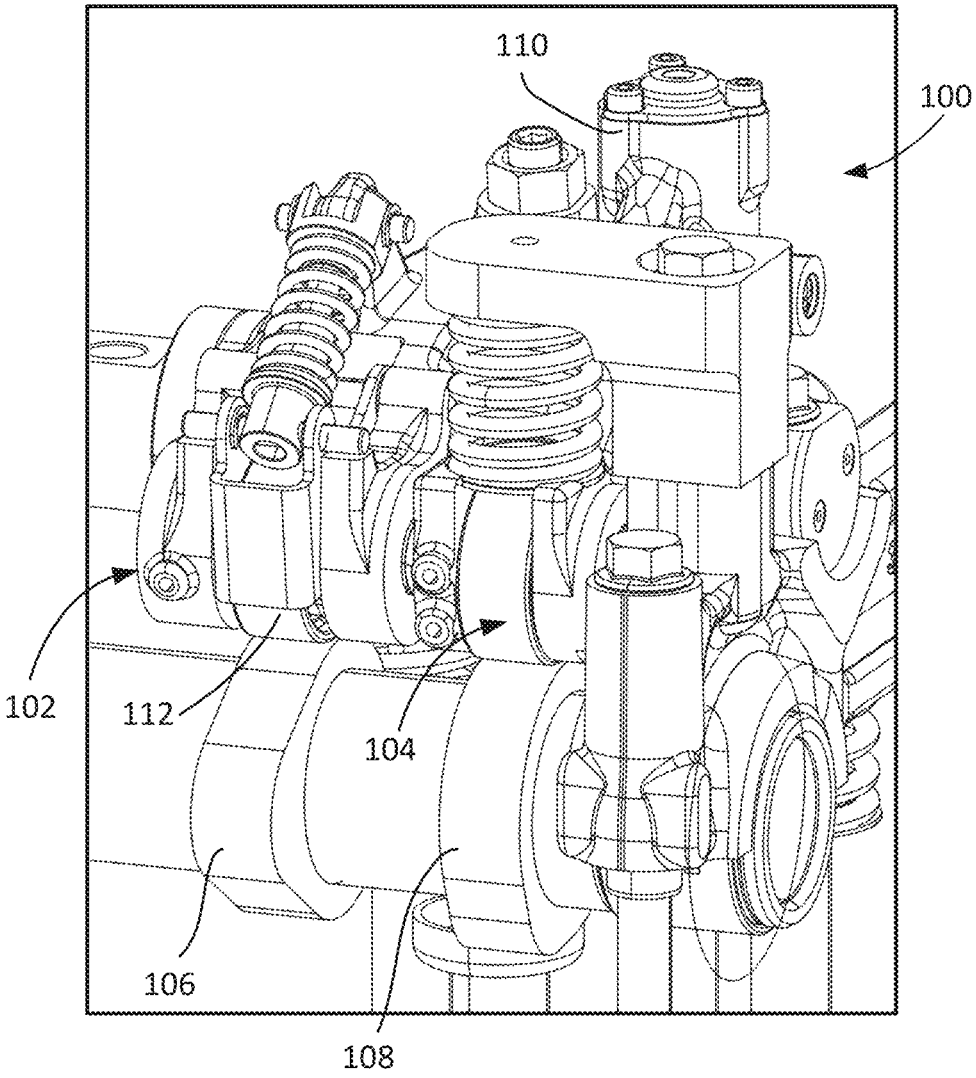
FIG. 1 is an isometric partial view of an example valvetrain system incorporating an embodiment of the synchronizing system according to this disclosure.

FIG. 1 illustrates an embodiment of a synchronizing system of this disclosure that may be suitable for use in valvetrain assembly 100. In particular embodiments, the valvetrain assembly 100 may comprise a first rocker arm 102 and a second rocker arm 104, respective end portions of which may ride on a first cam 106 and a second cam 108 of a camshaft in a manner known in the art. As shown, the first rocker arm 102 and the second rocker arm 104 are arranged in close proximity to each other. In some embodiments, the first rocker arm 102 and the second rocker arm 104 may be caused to make contact with one another in a way to form an interface therebetween. In particular embodiments, when used in connection with an internal combustion engine in the context of rocker arms for performing engine brake operation, the first rocker arm 102 may be a main exhaust rocker arm configured with deactivation functionality which, for example, may be used to selectively control exhaust movement of engine valves, while the second rocker arm 104 may be an engine brake rocker arm that is able to brake with the engine. Correspondingly, in such situation, the first cam 106 coupled to the main exhaust rocker arm may be a primary lift cam, whereas the second cam 108 coupled to engine brake rocker arm may be an engine brake lift cam. Typically, in a rocker arm constructed to achieve the so-called valve deactivation function—namely, a chosen combination of valves may be systematically disabled for the purpose of adjusting engine efficiency—a deactivating roller 112 is provided, which in the example as shown, may be configured to operatively engaged with the first cam 106 and is controllably movable relative to the first rocker arm 102 in such a way so as to enable and/or disable motion transfer from the camshaft to the associated engine valves based on need. Specifically, as an example, in operation, the deactivating roller 112 may be latched (e.g., advantageously by a switching mechanism, details of which will be further explained below) to a fixed relationship with and prevented from movement relative to the first rocker arm 102, thus forming a single unit with the first rocker arm 102 that as a whole can be lifted to allow valve actuation motion supplied by the camshaft to be conveyed to the engine valves. Conversely, if valve deactivation is needed, the deactivating roller 112 may be released from the latched position to an unlatched position where the deactivating roller 112 is free to reciprocate (e.g., in a vertical direction as shown) relative to the first rocker arm 102 to an extent that any rotational motion applied by the first cam 106 is absorbed by relative vertical movement between the deactivating roller 112 and the first rocker arm 102. Operation mode of this type is also referred to as lost motion, i.e., motion on the selected rocker arm is "lost", thus disabling the associated engine valves. In this way, by selectively controlling the deactivating roller 112 to switch between the latched and unlatched position, valve activation and deactivation can be performed accordingly.

Figure 2:
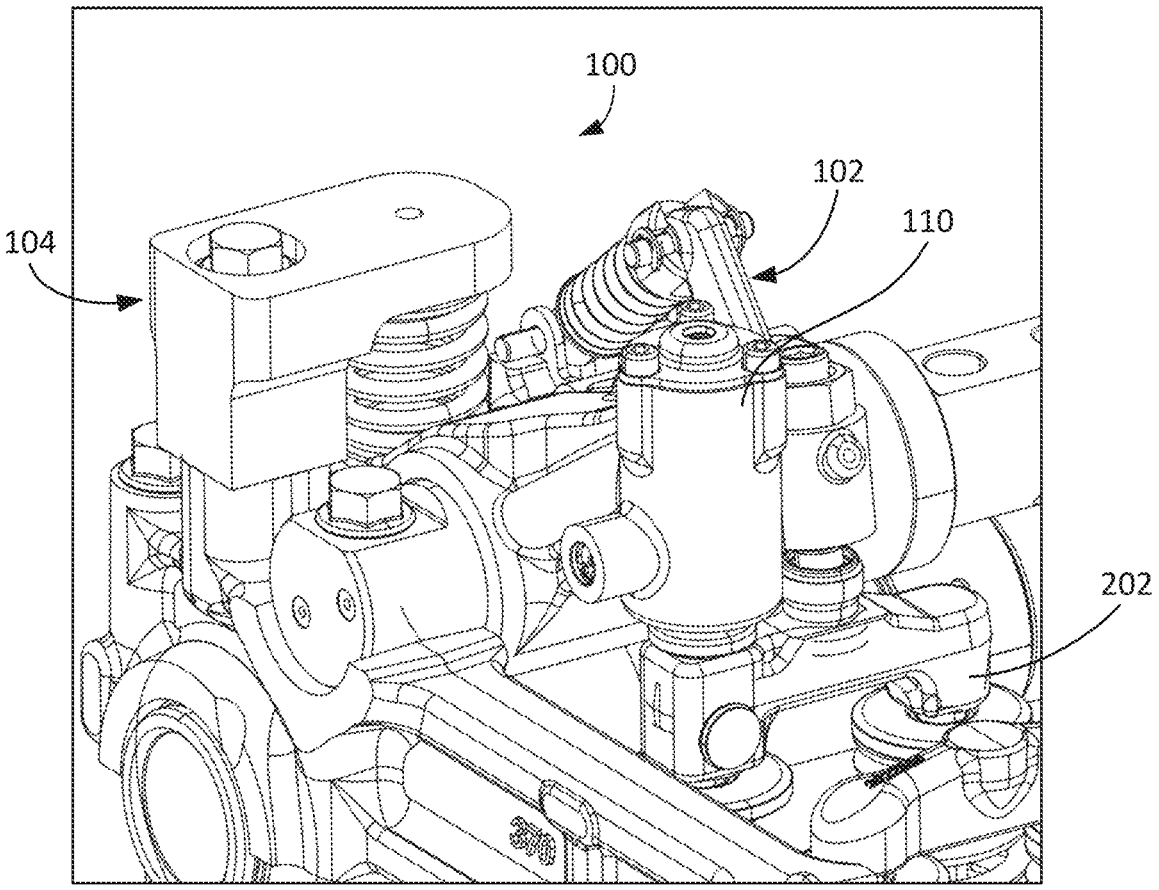
FIG. 2 is an isometric partial view showing portions of the back side of the example valvetrain system of FIG. 1.

FIG. 2 illustrates an isometric view of the back side of the valvetrain assembly 100 of FIG. 1, in which the first rocker arm 102 is shown to be operatively coupled to a valve bridge 202 spanning a first valve (such as a primary exhaust valve) and a second valve (such as a brake valve) in a manner that both the first valve and the second valve can be actuated simultaneously via the first rocker arm 102. The second rocker arm 104, on the other hand, may extend through the valve bridge 202 and act directly on the second valve so as to be able to actuate the second valve individually. In particular embodiments where the second rocker arm 104 serves as the engine brake rocker arm, the second rocker arm 104 may be configured to allow for selective actuation of the brake valve. To this end, for example, an engine brake capsule 110 is provided at one end of the second rocker arm 104 that is associated with the brake valve. As an example and not by way of limitation, the engine brake capsule 110 may be configured to be selectively translatable between an extended position, where actuation of the brake valve by the second cam 108 via the second rocker arm 104 is enabled, and a retracted position, where actuation of the brake valve is disabled. In particular embodiments, the engine brake capsule 110 may be hydraulicly actuated. As an example, the second rocker arm 104 may be arranged with one or more fluid channels for supplying pressurized fluid to the engine brake capsule 110 in a way to enable switching of the engine brake capsule 110, which will be described in greater details below. Additionally or alternatively, the valvetrain assembly 100 may be provided with other suitable configurations and functionalities that may be apparent to those skilled in the art in light of the specification, drawings, and claims disclosed herein and are therefore not explained in exhaustive details by this disclosure.

For a valvetrain assembly employing two switchable rocker arms such as the first rocker arm 102 and the second rocker arm 104 as described above, it may be desirable to synchronize the switching of the first rocker arm 102 and the second rocker arm 104 in order to deliver correct function as needed. For example, it may be beneficial to perform synchronous switching of the two rocker arms by a single control source. In this way, as compared to a conventional system requiring an independent control mechanism for each of the two rockers and a central unit to synchronize switching (typically by means of electric control signal), the synchronizing system in accordance with this disclosure that utilizes a single source for mechanically controlling synchronous switching may cut off half of the control system, thus simplifying the overall system by a considerable degree.

Further, in situations where correct sequence and timing of switching is critical, such as to facilitate added motion to a rocker to enable 1.5 or 2 stroke engine braking mode, the synchronizing system of this disclosure may ensure that activation of the engine brake is performed only after the main lift event of the main exhaust rocker is deactivated, thereby controlling the staggering of the main event deactivation and engine brake activation to not overlap. The valve main event used in a drive mode can be deactivated at the same time when the engine brake valve lift can be activated. The main event lift of the main rocker can be deactivated, thus avoiding excessive forces on the main rocker. Activation of the engine brake can then be performed after the deactivation of the main rocker.

Though particular embodiments of this disclosure are set forth in the context of rocker arms for operating exhaust valves in an engine braking system, for example, such as for use in 1.5 stroke decompression braking, nevertheless it is appreciated that the disclosure is not so limited. The synchronizing system in accordance with this disclosure is equally applicable to other types of rockers in a valvetrain assembly. For example, the disclosure may be applicable to an intake rocker arm system comprising a first intake rocker arm and a second intake rocker arm. In this regard, the camshaft may be configured with a primary lift cam and a secondary lift cam. Alternatively or additionally, for example, the disclosure may also be applicable to valvetrains configured for early exhaust valve opening, late intake valve closing or other variable valve lift configurations as familiar to those skilled in the art.

Figure 3:
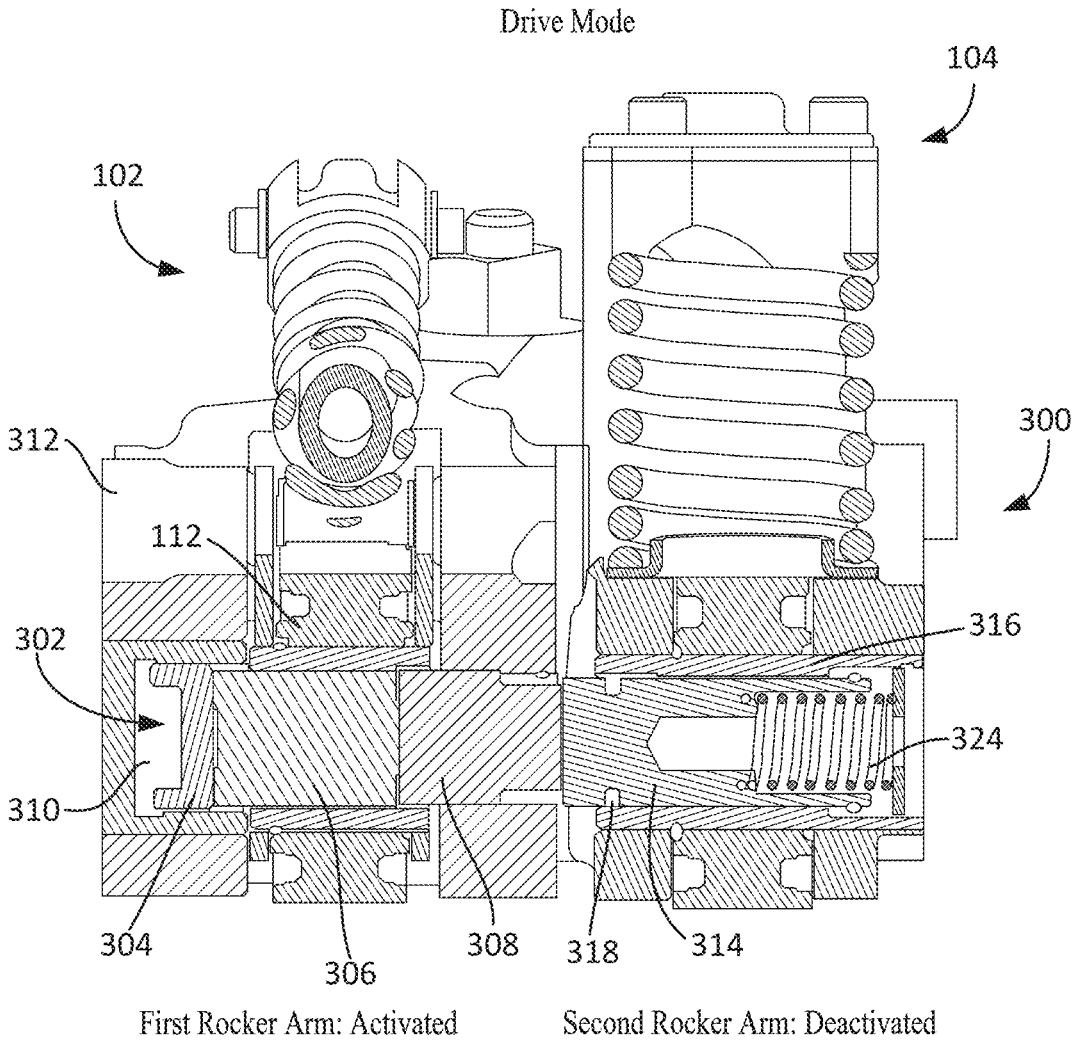
FIG. 3 is a cross-sectional view of the synchronizing system of FIG. 1, particularly illustrating positions of a first switching mechanism and a second switching mechanism when the synchronizing system is in drive mode.

FIG. 3 illustrates a synchronizing system 300 of this disclosure arranged in the valvetrain assembly 100 of FIG. 1, which may provide some or all of the benefits described above. In particular embodiments, a first switching mechanism 302 is provided, which may be used in combination with the deactivating roller 112 of the first rocker arm 102 for selectively controlling switching of the first rocker arm 102. In the example embodiment as depicted, the first switching mechanism 302 comprises a piston 304, a first pin 306, and a second pin 308, which are mechanically coupled together in series in such a manner that allows actuation motion applied to the piston 304 to accordingly push the first pin 306 and the second pin 308 to travel, e.g., horizontally to the right as shown in FIG. 3. The piston 304 of the first switching mechanism 302 may be housed inside a chamber 310 formed within body portion 312 of the main exhaust rocker arm 102. For example, the chamber 310 may be a fluid chamber in communication with a controllable fluid supply, such as an oil control valve that is suitable for providing pressurized oil into the chamber 310 on demand. In such a case, the piston 304 may be configured with a surface area such as a recessed area as shown, a flat area, or other possible area having surface structures that is suitable for receiving pressurized fluid (e.g., oil) in a manner that allows an increase of hydraulic pressure in the chamber 310 to be able to actuate the piston 304 (for example, horizontally to the right as shown). Alternatively or additionally, the piston 304 may be actuated by a source of force other than pressurized fluid, such as mechanically, electrically, or otherwise actuated in a way familiar to those skilled in the art.

In the embodiment illustrated in FIG. 3, the first pin 306, one end of which is movably coupled to or make contact with the piston 304, is shown to be at least partially accommodated by the deactivating roller 112 such that when the piston 304 is actuated, movement of the piston 304 may accordingly push the first pin 306 to translate along a certain distance through an inner volume formed in the deactivating roller 112. The other end of the first pin 306 may in turn be movably coupled to or interface with the second pin 308. Substantial portion of the second pin 308 is shown to be received by a passage formed inside body portion 312 of the first rocker arm 102, such that upon actuation by the piston 304, the second pin 308 may slide through and protrude beyond the passage. Although depicted as being generally cylindrical in shape, the first and second pin 306 and 308 may be constructed differently than as shown. It will also be appreciated that although described using the term pin, these features are not so limited. Those skilled in the art will recognize that it is possible to equally employ a latch, a block, a capsule, or other suitable structures which may be provided with a profile conforming to the interior space of the deactivating roller or the receiving passage of the first rocker arm body so as to be translatable arranged therein.

Figure 4:
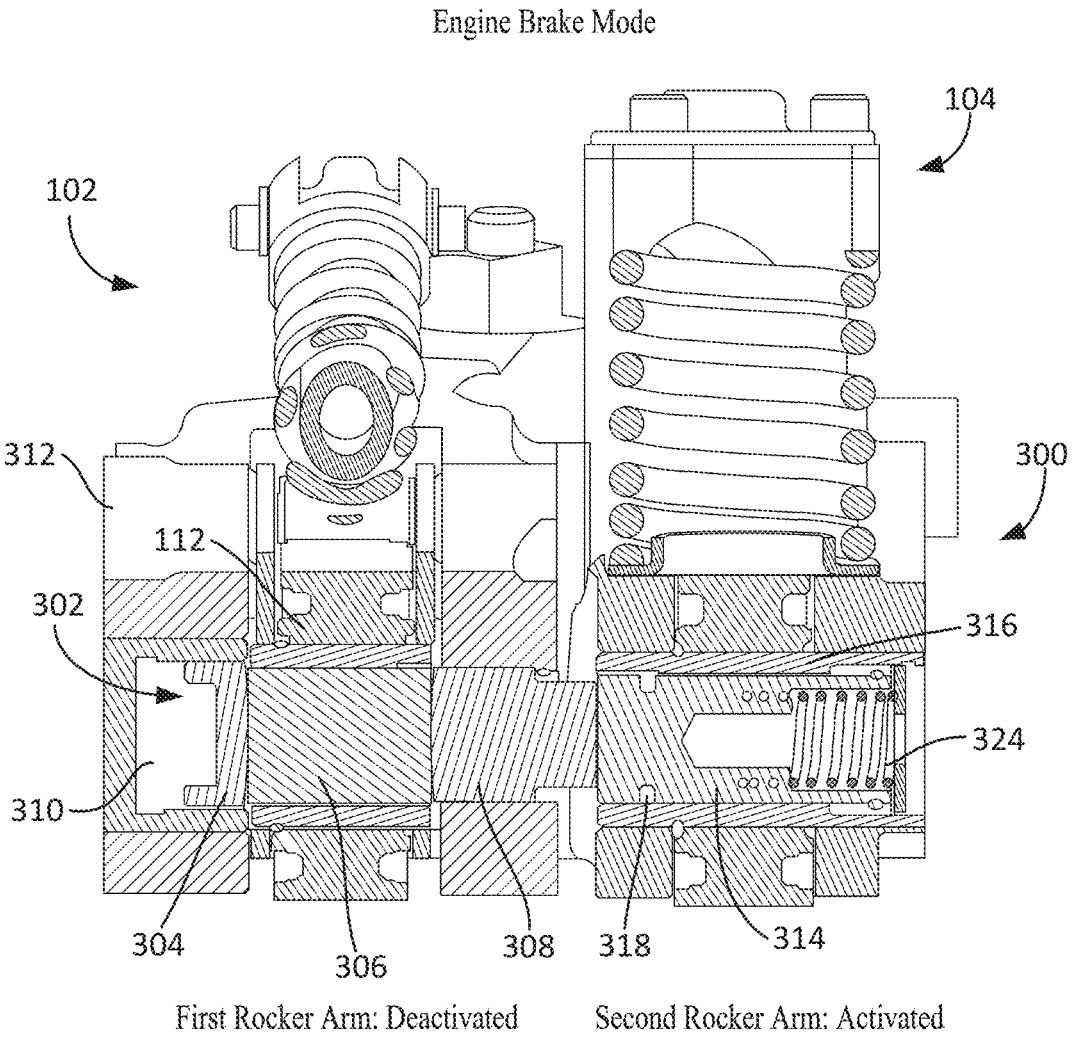
FIG. 4 is a cross-sectional view of the synchronizing system of FIG. 1, particularly illustrating positions of the first switching mechanism and the second switching mechanism when the synchronizing system is in engine brake mode.

In particular embodiments, in order to implement switching (e.g., valve deactivation), the first pin 306 which is interposed between the piston 304 and the second pin 308 may be allowed for relative movement with respect to the piston 304 and the second pin 308 in a direction that is generally perpendicular to the direction of travel of the first switching mechanism 302. For example, the first pin 306 may have a length that is substantially equal to the traverse length of the deactivating roller 112. In this way, when driven, the first pin 306 may slide to a position where its entire body is received within the outer boundary of the deactivating roller 112, thus allowing the first pin 306 to travel with the deactivating roller 112 (e.g., up and down in FIG. 3) while avoiding interference with relative motion of the deactivating roller 112 with respect to the first rocker arm 102. This configuration of the first rocker arm 102 is shown in FIG. 4. Operation of this type may be referred to as deactivation, where motion from the first cam 106 is absorbed by vertical displacement between the deactivating roller 112 and the first rocker arm 102. Conversely, for example, when valve activation is needed, the first pin 306 may retract to a latched position depicted in FIG. 3, where one end of the first pin 306 associated with the piston 304 extends out of the deactivating roller 112 and further engages with a side wall of the first rocker arm 102 in a way to lock the deactivating roller 112 into secure fixation with the first rocker arm 102. When this happens, the first rocker arm 102 is switched to activation mode and thus allowed to drive the related engine valves.

In particular embodiments, the second pin 308 may have a length greater than the receiving passage length of the first rocker arm 102 to such a degree that either of the two ends of the second pin 308 can protrude beyond lateral perimeter of the passage. For example, in the latched position as shown in FIG. 3, the end of the second pin 308 touching the first pin 306 may extend into the deactivating roller 112, thereby further latching the deactivating roller 112 with the first rocker arm 102. In the unlatched position shown in FIG. 4, the end of the second pin 308 contacting with the first pin 306 is driven to exit the deactivating roller 112 (i.e., free from engagement), thus unlocking the deactivating roller 112 to allow for movement thereof relative to the first rocker arm 102. Whereas the other end of the second pin 308 in turn protrudes outwards from the passage, and consequently drives a second switching mechanism of the second rocker arm 104, which will be described in greater details below.

In particular embodiments, the second switching mechanism of the second rocker arm 104 may take form as a spool valve 314, which is configured to be coupled to and arranged in physical contact with the second pin 308 such that horizontal movement of the second pin 308 may accordingly drive the spool valve 314. Alternatively, other suitable structures of the second switching mechanism are envisioned, such as a hydraulic capsule or the like. In particular embodiments, the spool valve 314 may be disposed in a roller axle 316 of the second rocker arm 104 and configured to be able to move between a first position and a second position. In the embodiment as illustrated, outer wall of the spool valve 314 may be configured with an annular groove, a recess, a through passage, or other suitable structures, which may advantageously form a flow channel 318 that allows fluid to be communicated therethrough. In some examples, a first flow circuit and a second flow circuit (not visible in the figures) may be ported to two respective openings formed on inner wall of the roller axle 316. Configured as such, when the spool valve 314 is driven by the first switching mechanism 302 (e.g., pushed by the second pin 308) to a proper location where the flow channel 318 on the spool valve 314 is aligned and/or engaged with the two openings, pressurized fluid may flow from one opening through the flow channel 318 to the other opening, thereby achieving fluid communication between the first flow circuit and the second flow circuit. As an example and not by way of limitation, the first flow circuit may be a fluid supply circuit that, for example, may be connected with an oil supply, while the second flow circuit may be fluidly connected to the engine brake capsule 110, which may be controlled via pressurized fluid flow to translate between an extended position and a retracted position so as to correspondingly enable and disable actuation of the brake valve.

In addition, in particular embodiments, a return spring 324 may be provided, which serves to bias both the first switching mechanism and the second switching mechanism. For example, the return spring 324 may be coupled to the terminal end of the spool valve 314 that is opposite from the end contacting with the second pin 308. In the embodiment as shown, the return spring 324 may be at least partially accommodated by the end of spool valve 314 in a manner that allows the return spring 324 to apply a biasing force against the end of the spool valve 314. As a further example, the return spring 324 may advantageously have a certain preload so as to urge both the spool valve 314 and the first switching mechanism 302 back to a neutral position (i.e., the position as shown in FIG. 3) if the piston 304 is not actuated. When this happens, the flow channel 318 arranged on the spool valve 314 may offset from the openings respectively connecting to the first and second fluid circuit, thereby interrupting fluid communication and cutting off fluid supply to the engine brake capsule 110. At the same time, the return spring 324 also urges (e.g., via the second switching mechanism) the first switching mechanism 302 to the latched position (shown in FIG. 3) and accordingly switches the first rocker arm 102 into activation. Alternatively, other suitable biasing element may be provided in place of the return spring 324 for performing the desired function of this disclosure, as will be appreciated by those skilled in the art.

Operation of the synchronizing system in accordance with disclosure is further described with reference to FIGS. 3-4 in the following, in which FIG. 3 shows the system in drive mode, whereas FIG. 4 shows the system in brake mode. In operation, a single actuation source may be employed that serves to drive both the first switching mechanism and the second switching mechanism in a synchronous fashion. For example, an oil control valve (not shown) may be ported to the chamber 310 inside the first rocker arm 102 and feed the chamber 310 with pressurized oil. The increase of oil pressure may force the piston 304 to move in the horizontal direction to the right as shown, thereby pushing the first pin 306 and the second pin 308 to the unlatched position that allows releasing of the deactivating roller 112 out of engagement with the first rocker arm 102, thus switching the first rocker arm 102 into deactivation (FIG. 4). Such movement of the first switching mechanism 302 in turn drives shifting of the spool valve 314 to an extent until the flow channel 318 formed on the spool valve 314 opens to the first fluid circuit and the second fluid circuit disposed inside the second rocker arm 104. As such, a flow pathway is established that enables fluid supplied from the first fluid circuit to flow through the spool valve 314 and the second fluid circuit until it finally reaches the engine brake capsule 110 connected downstream. In this way, main lift deactivation and engine brake activation may be synchronously controlled by a single oil control valve. Further, in some embodiments, the flow channel 318 positioned on the spool valve 314 may be used to create a delay between the valve deactivation process and the start of engine capsule extension, so that staggering of the main event deactivation and engine brake activation can be controlled to not overlap.

Conversely, when drive mode is demanded, the oil control valve may stop injecting pressurized oil into the chamber 310. Absent of such hydraulic actuation force, the first switching mechanism and the second switching mechanism may be biased to the left by the return spring 324 and return into the default position shown in FIG. 3. In this configuration, the first switching mechanism 302 securely latches the deactivating roller 112 to the first rocker arm 102, thus activating the first rocker arm 102 for main lift event. Meanwhile, the spool valve 314 is also biased by the return spring 324 to a position where the flow channel 318 is disconnected with the first and second fluid circuit such that fluid supply to the engine brake capsule 110 is interrupted. Accordingly, the second rocker arm 104 is switched to deactivation.

Figure 5:
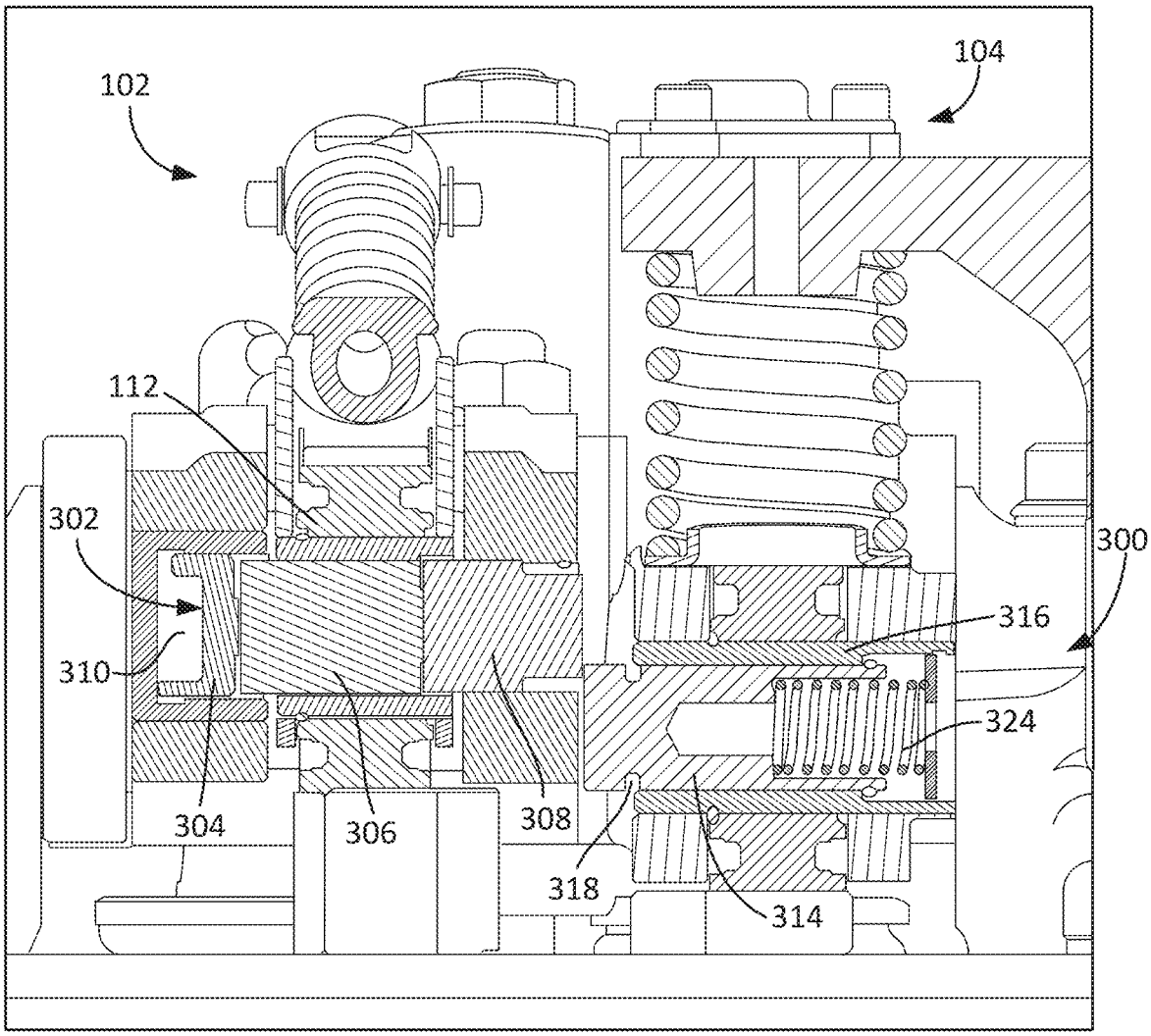
FIG. 5 is a cross-sectional view of the synchronizing system of FIG. 1, particularly illustrating positions of the first switching mechanism and the second switching mechanism when the first rocker arm is in a full lift drive mode while the second rocker arm is deactivated.

Referring now to FIG. 5, relative position of the first switching mechanism 302 and the spool valve 314 is illustrated in a situation where the first rocker arm 102 is in a full lift drive mode while the second rocker arm 104 is deactivated. In such a scenario, the first switching mechanism 302 is in its latched position, thus locking the deactivating roller 112 in a fixed relationship with the first rocker arm 102 so as to activate main lift event. At the same time, the engine brake capsule 110 is deactivated as its pressurized fluid supply is cut off by the spool valve 314 in the neutral position. As seen in FIG. 5, when the first rocker arm 102 is activated to reach the full lift position, the second pin 306 of the first switching mechanism 302 still maintain a certain level of contact (although minimally) with the spool valve 314 in the second rocker arm 104 despite of their relative vertical displacement. Therefore, it can be advantageously ensured that the spring force from the return spring 324 may continue to be applied to the first switching mechanism 302, thus biasing the first switching mechanism 302 so as to maintain secure locking throughout active main lift event.

Figure 6:
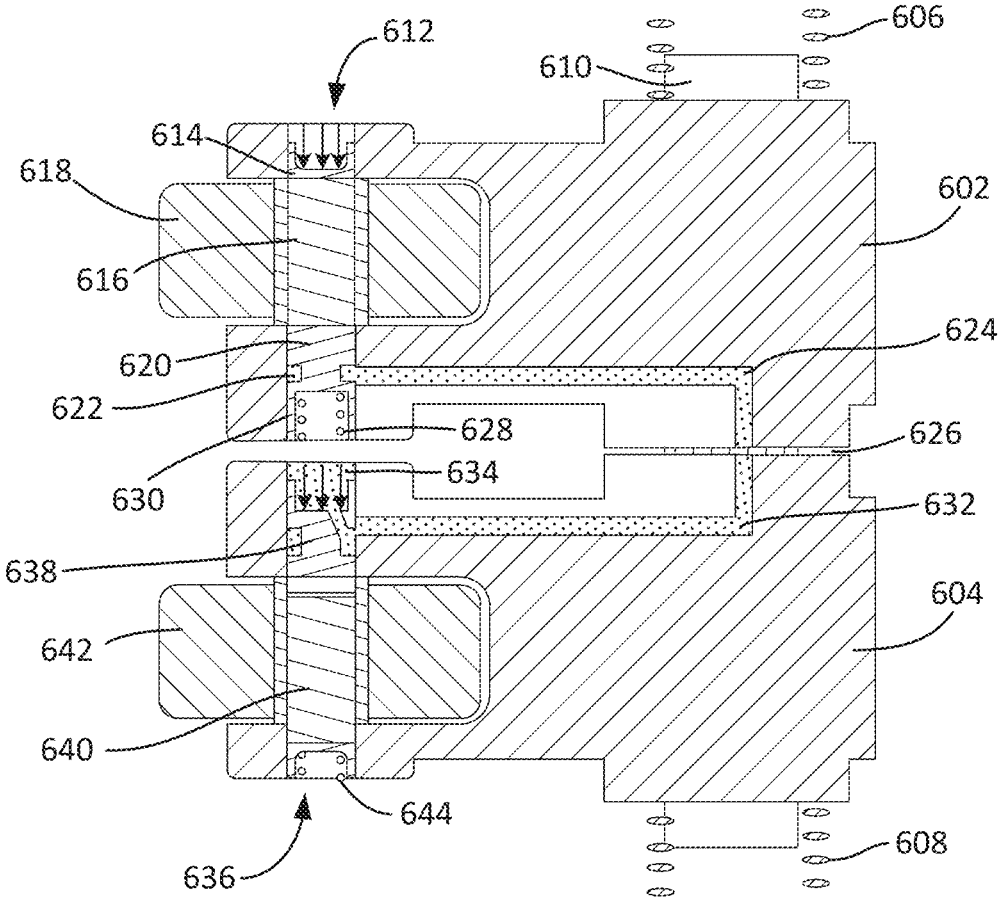
FIG. 6 is a schematic cross-sectional illustration of another embodiment of the synchronizing system according to this disclosure.

FIG. 6 illustrates another possible embodiment of a synchronizing system according to this disclosure. In this example embodiment, two rocker arms 602 and 604 are provided, which may be arranged to be pressed tight against each other in a substantially liquid sealed manner, for example, under the force applied by two biasing springs 606 and 608 respectively connected to the rocker arms 602 and 604 as shown. Alternatively, the two rocker arms 602 and 604 may otherwise be positioned in close proximity to each other by other suitable retaining means such as mechanical fasteners or the like. In the example embodiment as shown, the first rocker arm 602 may be pivotably supported by a rocker shaft 610 at one end (e.g., for performing rotational motion around the shaft in a known manner in the art) and provided with a first switching mechanism 612 near the other end. Similarly, the second rocker arm 604 may as well be pivotably supported by the rocker shaft 610 at one end and provided with a second switching mechanism 636 near the other end. The first and second switching mechanism 612 and 636 may advantageously enable synchronous switching of the first and second rocker arm 602 and 604 at a desired switching sequence and under the control of a single actuation source.

In order to control shifting of the first switching mechanism 612 on demand, in particular embodiments, the first switching mechanism 612 may be configured with a piston 614 that functions in a way similar to the piston 304 described above with reference to FIGS. 3-5. For example, the piston 614 may be actuated by a source of force such as via pressurized fluid injected through a pathway formed in the first rocker arm 602 to reach the piston 614. Of course, other actuation means are also possible for mechanically, electrically, or otherwise driving the piston 614 as needed. In particular embodiments, a first locking pin 616 is coupled to the piston 614 at the end of the piston 614 opposite from the other end associated with the actuation source such that when the piston 614 is actuated, movement of the piston 614 may correspondingly push the first locking pin 616, e.g., downward in a vertical direction as shown in FIG. 6. In the illustrated embodiment, the locking pin 616 is shown as being received in an interior space defined by a first deactivating roller 618 that is configured for relative displacement with respect to the first rocker arm body in a way similar to the deactivating roller 112 described above for enabling switching. Again, though described using the term pin, it will be understood that this feature may take form as other suitable structures for achieving the desired function of this disclosure.

In particular embodiments, the locking pin 616 is further connected to a spool valve 620, which is located in a chamber 630 formed inside the first rocker arm 602. For example, the spool valve 620 may be disposed to be in line with the piston 614 such that when the first deactivating roller 618 travels to a proper location relative to the first rocker arm 602, the first locking pin 616 accommodated by the interior space of the first deactivating roller 618 may be sandwiched between and coaxially aligned with the piston 614 and the spool valve 620.

Additionally, in this embodiment shown in FIG. 6, exterior surface of the spool valve 620 may be provided with surface structures such as an annular channel, a recess, or the like that may advantageously permit fluid passage therethrough. In particular embodiments, a first fluid circuit 622 and a second fluid circuit 624 may be formed inside the first rocker arm 602. As an example and not by way of limitation, the first fluid circuit 622 may be connected to a fluid source such as an engine pump that serves to provide pressurized oil to the chamber 630, while the second fluid circuit 624 may be routed from the chamber 630 to an interface 626 formed between the first rocker arm 602 and the second rocker arm 604. Both the first fluid circuit 622 and the second fluid circuit 624 may open into the chamber 630 at a position such that when the spool valve 620 is open (e.g., the position shown in FIG. 6), the first and second fluid circuit 622 and 624 may access the annular channel formed around the spool valve 620, thereby allowing pressurized fluid supplied from the first fluid circuit 622 to flow around the spool valve 620 and reach the second fluid circuit 624. Conversely, in situations where the groove of the spool valve 620 is not aligned with the first and second fluid circuit 622 and 624 (e.g., when the first switching mechanism 612 is in the latched position), fluid communication between the first and second fluid circuit 622 and 624 may be disrupted by the spool valve 620.

Figure 7:
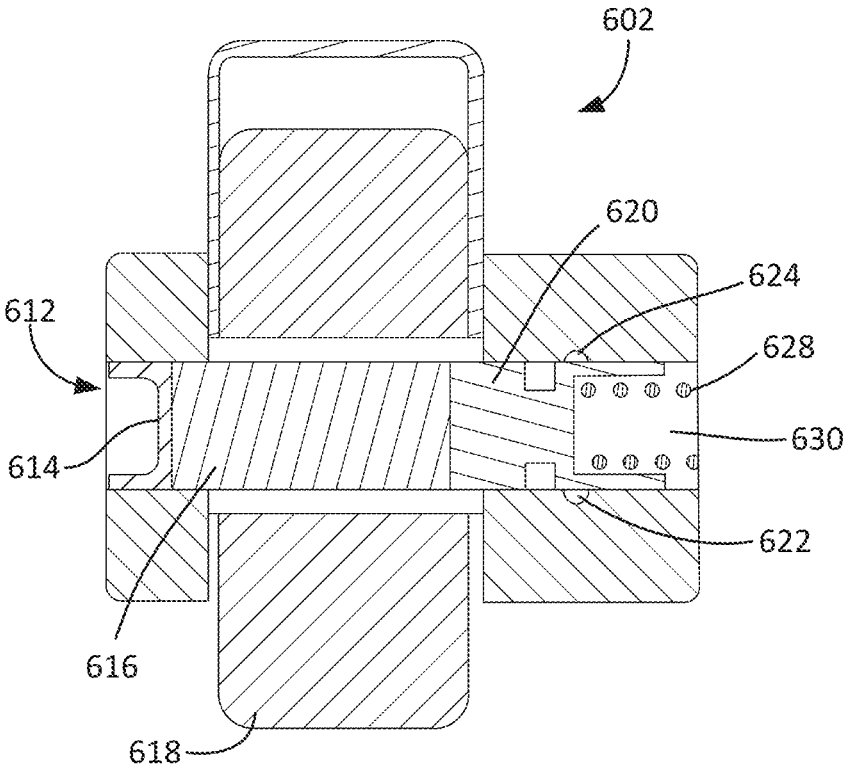
FIG. 7 is a schematic cross-sectional illustration showing a first rocker arm of the synchronizing system of FIG. 6, where the first rocker arm is in a first position.

As further shown in FIG. 6, the spool valve 620 may be provided with a first return spring 628 attached to one end thereof opposite from the other end contacting with the locking pin 616. For example, the return spring 628 may be housed within a cavity formed at the end of the spool valve 620. In particular embodiments, the return spring 628 may apply a spring force (e.g., in the upward direction) that urges the spool valve 620 to return to a default position (as shown in FIG. 7, which will be explained in greater details below), and consequently drives the first locking pin 616 and the piston 614 vertically upwards as well.

In particular embodiments, the second rocker arm 604 located downstream of the first rocker arm 602 may be constructed with a third fluid circuit 632, which for example may be opened to the interface 626 between the first and second rocker arm 602 and 604 in such a position to make fluid connection with the opening of the second fluid circuit 624 on the interface 626. The other end of the third fluid circuit 632 may be routed to a fluid chamber 634 that houses portions of the second switching mechanism 636. In this way, fluid to be supplied from the first rocker arm 602 may be communicated through the interface 626 to the second rocker arm 604. When this happens, fluid such as pressurized oil injected into the fluid chamber 634 may move the second switching mechanism 636, e.g., downwards in the vertical direction as shown.

In particular embodiments, the second switching mechanism 636 may be provided with a valve structure 638 that is configured to be able to be hydraulicly actuated by the fluid reaching the fluid chamber 634. As an example, the valve structure 638 may be designed with a through passage that fluidly connects the terminal end of the third fluid circuit 632 with interior space of the fluid chamber 634. Alternatively or additionally, exterior wall of the valve structure 638 may be further grooved so as to form additional fluid passage around the valve structure 638.

As further shown in the FIG. 6, the end of the valve structure 638 that is opposite from the fluid-associated end may be further connected to a second locking pin 640 in a motion conveying manner such that movement of the valve structure 638 (e.g., downwards when driven by increase of fluid pressure in the fluid chamber 634) may correspondingly drive the second locking pin 640. The second locking pin 640 may be generally cylindrical in shape and can fit through inner space of a second deactivating roller 642 of the second rocker arm 604 so as to be movably contained therein. Once again, the second locking pin 640 may be configured differently than as shown for performing the desired operation of this disclosure. The lower end of the second locking pin 640 may be coupled to a biasing element comprising a second return spring 644, which serves to apply an upward spring force to the second switching mechanism 636. Configured in this manner, it will be appreciated that the second switching mechanism 636 may perform a similar switching function as described above, e.g., to the extent that the second switching mechanism 636 travels downwards until the valve structure 638 and the second locking pin 640 latches with the second deactivating roller 642, lift event of the second rocker arm 604 is effectively activated.

Figure 8:
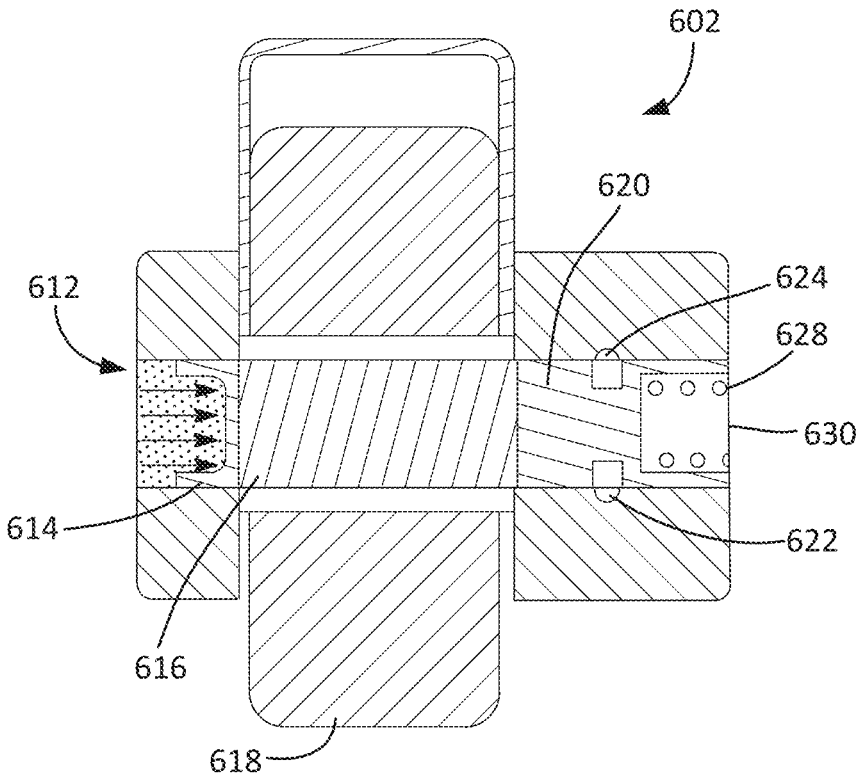
FIG. 8 is a schematic cross-sectional illustration showing the first rocker arm of the synchronizing system of FIG. 6, where the first rocker arm is in a second position.

With reference to FIGS. 7 and 8, operation of the synchronizing system of FIG. 6 is described, in which FIG. 7 shows the first switching mechanism 612 in its first position (e.g., latched state), while FIG. 8 shows the first switching mechanism 612 in its second position (e.g., unlatched state).

In the latched position of FIG. 7, for example, when actuation force is no longer applied to the piston 614, the biasing force from the first return spring 628 may push the first switching mechanism 612 in a direction (e.g., to the right as shown in FIG. 7) opposing the actuation force transmission that may otherwise be received by the piston 614. When this happens, portion of the spool valve 620 may extrude beyond the outer perimeter of the chamber 630 and engage with the first deactivating roller 618, thus locking the first deactivating roller 618 to a fixed position relative to the first rocker arm 602. The first locking pin 616 maintaining contact with the spool valve 620 may accordingly be driven in a similar manner into engagement with the passage that contains the piston 614, thereby further locking the first deactivating roller 618 in place.

When biased to such default position, the groove formed on exterior surface of the spool valve 620 may be offset from the respective openings of the first and second fluid circuit 622 and 624, such that any fluid flow originating from the first fluid circuit 622 is blocked by the solid external wall of the spool valve 620. Consequently, although not shown in FIG. 7, fluid communication to the second rocker arm 604, in particular to the fluid chamber 634 associated with the second switching mechanism 636, is disabled. As such, due to absence of the hydraulic actuation force in the fluid chamber 634, the second switching mechanism 636 may return to the unlatched position under the influence of the second return spring 644, thus switching the second rocker arm 604 to deactivation. In this way, deactivation of the second rocker arm 604 may occur after activation of the first rocker arm 602, thereby ensuring correct sequence of switching of the first and second rocker arm 602 and 604.

Turning now to FIG. 8, the second position of the first rocker arm 602 is illustrated, in which the first switching mechanism 612 is driven by the source of force (e.g., under control of an oil control valve) to shift horizontally to the left to the extent that the first deactivating roller 618 is released. In such a scenario, the spool valve 620 is pushed to a proper location where the groove on the spool valve 620 may intersect both the first and second fluid circuit 622 and 624, thereby enabling fluid communication therebetween. Therefore, fluid supplied from the first fluid circuit 622 is permitted to flow through the second fluid circuit 624 passing the interface 626 between the first rocker arm 602 and the second rocker arm 604 into the third fluid circuit 632 and finally reaching the fluid chamber 634 (not shown in FIG. 8). Increased fluid pressure in the fluid chamber 634 may shift the second switching mechanism 636 into the latched position, thus activating the second rocker arm 604. In this manner, a single motion source (e.g., the oil control valve coupled to the first rocker arm 602) may be used to simultaneously control both deactivation of the first rocker arm 602 and activation of the second rocker arm 604.

Various possible embodiments as described above may be taken in combinations or sub combinations for achieving some, if not all, advantages according to this disclosure. Features described by referencing to one embodiment may be equally applicable to other embodiments as well provided that necessary adaptation has been made in a manner familiar to those skilled in the art. For example, the second rocker arm described with reference to FIGS. 1-5 that is configured with the engine brake capsule may alternatively be employed in place of the second rocker arm of FIGS. 6-8 comprising the second deactivating roller. As a further example, the first rocker arm of FIGS. 1-5 provided with the second pin that mechanically couples to the second rocker arm may be modified to include one or more fluid circuits in order to hydraulicly interface with the second rocker arm. It will be appreciated that other possible combinations or design variations may be apparent to one of ordinary skill in the art in light of the description, claims, and drawings without departing from the scope of this disclosure.

Herein, "or" is inclusive and not exclusive, unless expressly indicated otherwise or indicated otherwise by context. Therefore, herein, "A or B" means "A, B, or both," unless expressly indicated otherwise or indicated otherwise by context. Moreover, "and" is both joint and several, unless expressly indicated otherwise or indicated otherwise by context. Therefore, herein, "A and B" means "A and B, jointly or severally," unless expressly indicated otherwise or indicated otherwise by context.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, feature, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative. Additionally, although this disclosure describes or illustrates particular embodiments as providing particular advantages, particular embodiments may provide none, some, or all of these advantages.

What is claimed is:

1. A system for synchronization, comprising:

a first rocker arm configured to be switchable between a first mode and a second mode, wherein the first mode activates the first rocker arm to enable motion transfer to a first engine valve, and the second mode deactivates the first rocker arm to disable motion transfer to the first engine valve;

a second rocker arm configured to be switchable between a third mode and a fourth mode, wherein the third mode activates the second rocker arm to enable motion transfer to a second engine valve, and the fourth mode deactivates the second rocker arm to disable motion transfer to the second engine valve;

a first switching mechanism arranged in the first rocker arm and configured to controllably switch the first rocker arm between the first mode and the second mode by moving between a first position and a second position; and a second switching mechanism arranged in the second rocker arm and configured to controllably switch the second rocker arm between the third mode and the fourth mode by moving between a third position and a fourth position;

wherein movement of the first switching mechanism and movement of the second switching mechanism are actuated by a single actuation source; and wherein movement of the first switching mechanism between the first position and the second position causes the second switching mechanism to move between the third position and the fourth position such that switching of the first rocker arm and the second rocker arm occurs in sequence.

2. The system of claim 1, wherein the single actuation source is a fluid control valve.

3. The system of claim 1, wherein the first rocker arm and the second rocker arm are arranged in close proximity to each other.

4. The system of claim 1, wherein at least a portion of the first switching mechanism and at least a portion of the second switching mechanism are configured to maintain physical contact with each other.

5. The system of claim 4, further comprising a return spring coupled to the second switching mechanism and configured to bias both the first switching mechanism and the second switching mechanism.

6. The system of claim 1, wherein the first rocker arm comprises a deactivating roller, which is configured to be selectively latched by the first switching mechanism such that the first rocker arm is selectively switched between the first mode and the second mode.

7. The system of claim 1, wherein the second rocker arm comprises a first fluid circuit and a second fluid circuit.

8. The system of claim 7, wherein the second switching mechanism comprises a spool valve.

9. The system of claim 8, wherein the spool valve is configured to selectively enable or disable fluid communication between the first fluid circuit and the second fluid circuit of the second rocker arm such that the second rocker arm is selectively switched between the third mode and the fourth mode.

10. The system of claim 1, wherein the first switching mechanism comprises a spool valve.

11. The system of claim 10, wherein the first rocker arm comprises a first fluid circuit and a second fluid circuit.

12. The system of claim 11, wherein the spool valve is configured to selectively enable or disable fluid communication between the first fluid circuit and the second fluid circuit of the first rocker arm.

13. The system of claim 12, wherein the second rocker arm comprises a third fluid circuit that is configured to hydraulicly interface with the second fluid circuit of the first rocker arm.

14. The system of claim 13, wherein movement of the second switching mechanism is actuated by fluid supplied from the first fluid circuit through the second fluid circuit to the third fluid circuit such that the second rocker arm is switched between the third mode and the fourth mode.

15. The system of claim 14, further comprising a first return spring coupled to the first switching mechanism and configured to bias the first switching mechanism, and a second return spring coupled to the second switching mechanism and configured to bias the second switching mechanism.

16. The system of claim 1, wherein the first rocker arm and the second rocker arm are biased to press against each other by one or more biasing springs.

17. A switching system for synchronization of a first rocker arm and a second rocker arm, the switching system comprising:

a first switching mechanism configured in the first rocker arm to controllably switch the first rocker arm, the first switching mechanism being movable between a first position and a second position and comprising a piston, a first pin, and a second pin coupled in series; and a second switching mechanism configured in the second rocker arm to controllably switch the second rocker arm, the second switching mechanism being movable between a third position and a fourth position and comprising a spool valve;

wherein movement of the first switching mechanism and movement of the second switching mechanism are actuated by a single actuation source; and wherein movement of the first switching mechanism between the first position and the second position causes the second switching mechanism to move between the third position and the fourth position such that switching of the first rocker arm and the second rocker arm occurs in sequence.

18. The switching system of claim 17, wherein the second pin of the first switching mechanism and the spool valve of the second switching mechanism are configured to maintain physical contact with each other.

19. A switching system for synchronization of a first rocker arm and a second rocker arm, the switching system comprising:

a first switching mechanism configured in the first rocker arm to controllably switch the first rocker arm, the first switching mechanism being movable between a first position and a second position and comprising a piston, a first pin, and a spool valve coupled in series; and a second switching mechanism configured in the second rocker arm to controllably switch the second rocker arm, the second switching mechanism being movable between a third position and a fourth position and comprising a valve structure and a second pin;

wherein movement of the first switching mechanism and movement of the second switching mechanism are actuated by a single actuation source;

wherein movement of the first switching mechanism between the first position and the second position causes the second switching mechanism to move between the third position and the fourth position such that switching of the first rocker arm and the second rocker arm occurs in sequence; and wherein the spool valve of the first switching mechanism controls fluid communication to the valve structure of the second switching mechanism.

* * * * *